US008167668B2

(12) United States Patent
Robicheaux

(10) Patent No.: US 8,167,668 B2
(45) Date of Patent: May 1, 2012

(54) AIR-THRUST VEHICLE

(76) Inventor: Mark Joseph Robicheaux, Franklin, LA (US)

( * ) Notice: Subject to any disclaimer, the term of this patent is extended or adjusted under 35 U.S.C. 154(b) by 304 days.

(21) Appl. No.: 12/583,966

(22) Filed: Aug. 28, 2009

(65) Prior Publication Data

US 2011/0053438 A1 Mar. 3, 2011

(51) Int. Cl.
*B63H 7/00* (2006.01)

(52) U.S. Cl. ..... 440/37

(58) Field of Classification Search ..... 440/37
See application file for complete search history.

(56) References Cited

U.S. PATENT DOCUMENTS 2,475,889 A 7/1949 Hafele
2,698,447 A 1/1955 Potts
2,987,281 A 6/1961 Schurr
3,791,333 A 2/1974 Losch
3,795,927 A * 3/1974 Darwin et al. ..... 114/363
3,918,734 A 11/1975 Firth et al.
4,005,673 A * 2/1977 Carrero ..... 440/37
4,357,894 A 11/1982 Kirk
4,382,574 A 5/1983 Ellestad
4,766,838 A 8/1988 Johnson
5,218,918 A 6/1993 Cline
5,499,792 A 3/1996 Tamiso
7,090,549 B2 * 8/2006 Garcia ..... 440/37

* cited by examiner

*Primary Examiner* — Stephen Avila
(74) *Attorney, Agent, or Firm* — Keaty Law Firm, LLC

(57) ABSTRACT

An air-thrust marine vehicle has a hull with upwardly extending hull sides. An air-thrusting propulsion unit is configured for detachable mounting on the gunwales of various width hulls. The propulsion unit has a base assembly configured to move between a retracted position and plurality of expanded width positions for accommodating various width hulls, while being configured to hingedly engage the gunwales. The propulsion unit can be removed from the vehicle and positioned on another vehicle, such as a boat, an ice- or snow-traversing vehicle.

13 Claims, 13 Drawing Sheets

AIR-THRUST VEHICLE

BACKGROUND OF THE INVENTION

The present invention relates to vehicles that are propelled by air-thrusting mechanisms and, more particularly, to a flat-bottomed light boat with a fan propeller designed for flotation in shallow waters. This invention also pertains to a propulsion unit that moves the air-thrust vehicle.

Air-thrusting water craft serve unique purposes along water courses that are difficult to navigate by standard water vehicles. In swamps and other shallow waterways, such as exist in Florida and Louisiana, grasses and underwater vegetation make navigation in conventional water craft hazardous and difficult. One of the disadvantages of using boats with outboard motors is that they use the same trail numerous times; every time they pass it is easier and less resistance, but it damages the root structure of the vegetation growing in the mud. The current churns up the mud, loosens it up and more of it will wash out when the tide goes out. The air-thrusting mechanism of the air boat eliminates the need for water guided rudders, centerboards, and water propulsion impellers.

The engine and propeller of an air boat are typically enclosed in a protective metal cage that prevents objects, e.g., tree limbs, branches, user's clothing or wildlife from coming in contact with the whirling propeller, which could cause devastating damage to the vessel and traumatic injury to the operator and passengers. The propeller produces a rearward column of air that propels the airboat forward. Steering is accomplished by forced air passing across vertical rudders. There must be a forceful airflow in order for the vessel to be steered. Airboats do not have brakes; they cannot travel in reverse.

The characteristic flat-bottomed design of the airboat, in conjunction with the fact that there are no operating parts below the waterline permit the vessel to be easily navigated through shallow swamps, marshes, lakes and rivers. Airboats vary in size from 10-foot hunt/trail boats, with a two- to three-passenger capacity, to large 18-passenger and greater tour boats.

In recent years airboats have grown in popularity in the area of public safety. Airboats have proven to be indispensable for flood, shallow water and ice rescue operations. During the flooding of New Orleans following Hurricane Katrina in August of 2005, airboats from across the United States rescued thousands of flood victims. Thirty airboats evacuated over 3,000 patients and medical staff from four downtown New Orleans hospitals in less than 36 hours. The advantages, capabilities and benefits of using airboats for water rescue operations have been described in various articles. As a consequence, despite the limitations in steering of the air boats, the benefits of the air-propelled watercraft account for increase in this type of vehicle in a variety of industries.

Another attractive use of the air boats is for tourism industry. The original airboats were built tall, which allowed passengers a wide view of the area. The smaller airboats cannot run through grass of that height. Because of the lower horsepower used by smaller boat engines they cannot travel through the same areas.

Airboats are powered by either an aircraft or large block automotive engine, ranging from 125 to over 600 horsepower. Replacement parts and ease of repair make the automotive engine the preferred power source. Also, high octane automotive gas is less expensive than aviation gas required by the aircraft engines. An automotive engine powered airboat generally has more power to push through high grass or carry heavy loads. An aircraft engine powered airboat may still be preferred in situations where a light boat or greater maneuverability is desired.

The factory-built air boats are relatively expensive. However, the advantages afforded by the air-thrust motor can be made available for other boats that use conventional outboard motors. The outboard motors can be usually easily dismounted from the boat for storage or repair. The present invention contemplates provision of a mounting assembly for an air-thrust motor that can be mounted on a conventional boat in place of an outboard motor and make the modified watercraft for operation in shallow water, swamps and marshes.

SUMMARY OF THE INVENTION

It is, therefore, an object of the present invention to provide a mounting assembly for an air-thrust mechanism to allow retrofitting of a boat to an air boat.

It is another object of the invention to provide a mounting assembly for an air-thrust mechanism to allow easy mounting and dismounting of a fan motor on a stern of a boat.

These and other objects of the invention are achieved through a provision of an air-thrust vehicle, which can navigate on water, ice, snow and other surfaces. The vehicle has a hull having upwardly extending hull sides and an air-thrusting propulsion unit configured for detachable mounting on the hull sides. The propulsion unit comprises a base assembly configured to move between a retracted position and plurality expanded width positions for accommodating various width hulls.

Propulsion unit has a base assembly with slidably telescopically extendable hull mounting brackets, which hingedly engage gunwales of the hull. The propulsion unit is powered by an engine that generates torque transmitted through a drive unit to a propeller. Steering is performed by a tiller arm mounted forward of the engine and a pair of pivotally moving rudders mounted aft of the propeller.

The engine, the drive unit, and the propeller of the propulsion unit are enclosed in a cage to protect the user from rapidly moving parts. The base assembly comprises a base frame having elongated tubular side members secured in a substantially parallel relationship to each other and hull mount members telescopically engageable with the side members, said hull mount members being configured to rest on and hingedly engage the gunwales. Each of the hull mount members is generally U-shaped with a pair of parallel slide members, a cross bar secured between the slide members and a hull mount bracket hingedly secured to the cross bar.

The base assembly also comprises an arched leg secured to and extending upwardly from, each of the side members, and a base plate positioned on the arched legs. An engine mount plate supports the engine on the base plate. A plurality of flexible resilient members mounted in cylindrical receivers absorbs engine vibrations and drive unit vibrations. The engine vibration receivers are positioned below the engine mount plate, while the drive unit vibration receivers are mounted below attachment brackets that secure the drive unit to the base plate.

The vehicle on which the propulsion unit is mounted can be a flat-bottomed boat, or punt, in the aft area of which the propulsion unit of the present invention is configured for mounting.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
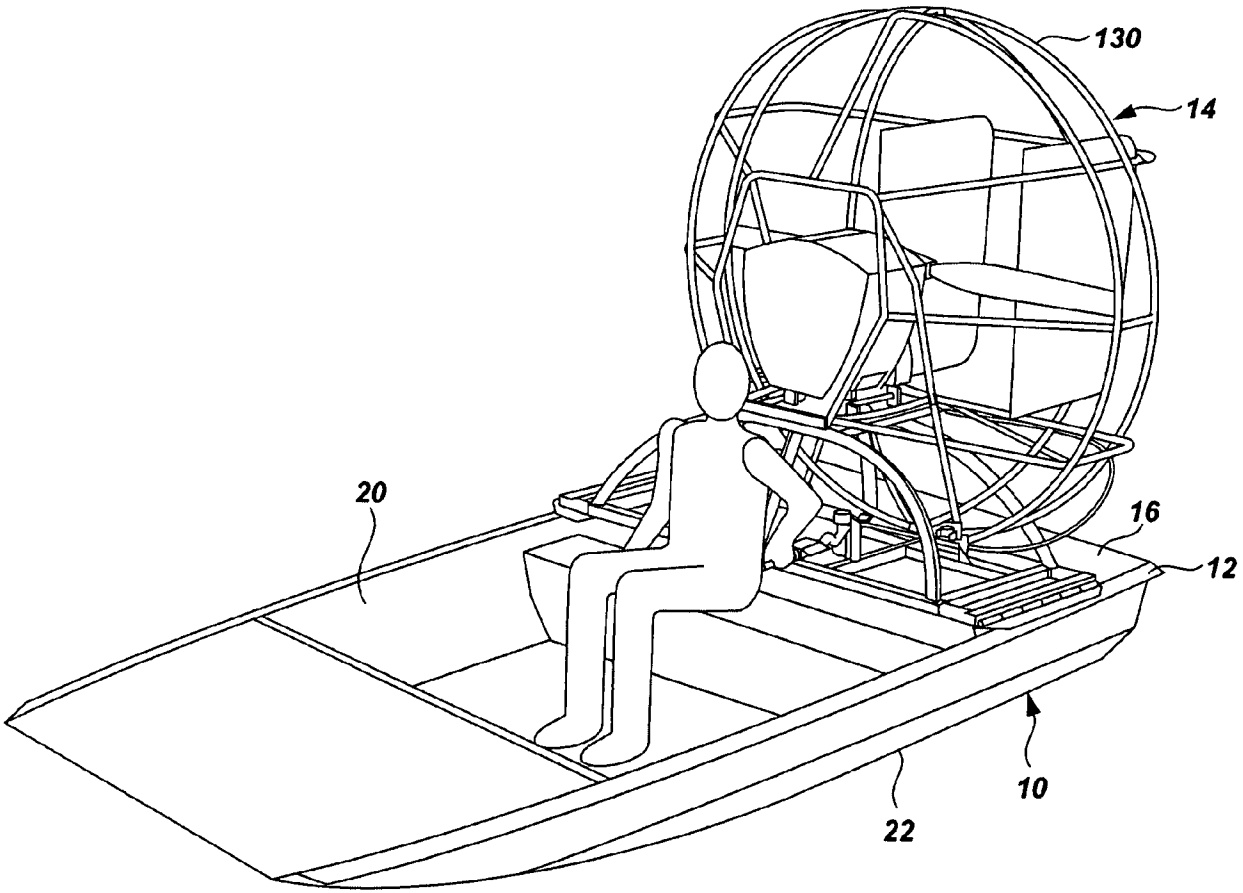
FIG. 1 is a perspective view showing the air-thrusting motor of the present invention motor positioned on a boat.

Turning now to the drawings in more detail, numeral 10 designates a boat, to the gunwale 12 of which an air-thrusting propulsion unit 14 is mounted. The boat 10 has an aft or stern area 16, where a steering unit 18 is positioned forwardly of the propulsion unit 14. The shallow-water boat 10 has a hull 20 with a flat bottom 22. The boat 10 is a low-sided boat; it is built to cruise along the edges of lakes and in small back alley waterways. Such boats are particularly beneficial in areas with dense vegetation since the air-thrusting propulsion unit 14 is mounted above the water line.

The engine 24 rests on an engine mount plate 26, which is detachably secured to the bottom of the engine 24 by a plurality of bolts 26 extending through washers 27 and nuts 28. Generally, the engine 24 is positioned low with respect to the hull 20 of the boat 10 so as to lower the center of gravity of the propulsion unit 14.

A pair of hollow machined steel cone mount receivers 30 is secured to a bottom of the engine mount plate 24. The receivers 30 are each configured to receive flexible resilient cone mounts 32. The cone mounts may be formed from rubber or other suitable material for absorbing vibration generated by the engine 24 and to prevent engine vibration transmitted through the engine stand and base plate from causing structural damage to the propeller guard. Each of the cone mounts 32 is detachably engaged with a respective receiver 30 using bolts 33 and washers 34.

A similar pair of rubber cone mounts 36 is configured for detachable engagement with the opposite ends of the receivers 30. A ring-shaped washer 37 is fitted into each receiver 30 and is secured therein by the threaded ends of the bolts 33 using internally threaded nuts 38.

A propeller 40 is operationally engaged with the engine unit 24 for receiving torque from the engine unit 24 through a drive unit 42 secured in torque receiving relationship to the engine unit 24.

A drive unit mount assembly 46 secures the drive unit 42 to a base plate 71, as will be described below. The drive unit mount assembly 46 comprises a pair of L-shaped brackets 47 that are secured to the drive unit 42 by a plurality of bolts 45 fitted into openings 43 formed in the upright portions of the L-shaped brackets 47. The horizontal portions of the L-shaped brackets 47 are attached to hollow machined steel cone mount receivers or sleeves 48.

Similarly to the receivers 30, the cylindrically-shaped receivers 48 engage oppositely oriented rubber cone mounts 49 and 50 that fit into open ends of the hollow receivers 48. Elongated bolts 52 secure each pair of receivers 49, 50 along with the washers 53, 54 to support brackets 75 on the base plate 71, as will be described below. The threaded ends of the bolts 52 are secured by internally threaded nuts 55.

The engine unit 24 is operationally connected to a muffler 60 by a pair of muffler pipes 62 that extend on opposite sides of the engine unit 24 to reduce the noise created by the engine unit 24. A pair of exhaust pipes 63 allows exhaust of gases from the muffler 60.

The engine unit 24, with the muffler 60, the drive unit 42 and the propeller 40 are detachably mounted on a superstructure, or base 70, which elevates the engine and the propeller 40 above the stern area and the gunwale 12. The base 70 comprises a base plate 71 secured on top of a pair of arched legs 72, 74. Two upwardly extending rear brackets 75 are secured to the upper surface of the base plate 71. The bolts 52 of the drive unit mount assembly 46 pass through the washers 53, holes formed in the rear brackets 75, rubber cones 49, the receivers 48, rubber cones 50, washers 54 and are finally secured by the nuts 55.

A pair of forward brackets 76 is secured to the base plate 71 opposite the rear brackets 75. The brackets 76 are spaced to receive the engine mount plate 26 therebetween. The bolts 33 pass through the washers 34, openings formed in the forward brackets 76, rubber cones 32, then through the receivers 30, rubber cones 36, and washers 37, with the ends of the bolts 33 being engaged by the nuts 38.

A base frame 80 supports the ends of the arched legs 72, 74. The base frame 80 has a generally rectangular configuration and is comprised of two elongated side members 81, 82 and two cross members 83, 84 secured between the side members 81, 82. The side members 81, 82 are formed as elongated hollow bodies configured to receive hull mount members 86, 87 in a slidable telescopic relationship therein.

The hull mount member 86 has a generally U-shaped configuration with two parallel bars 88, 89 and one cross bar 90 secured at right angle to the ends of the parallel bars 88, 89. The hull mount member 87 similarly has a generally U-shaped configuration with two parallel bars 91, 92 and one cross bar 93 secured at right angle to the ends of the parallel bars 91, 92. The side member 81, 82 each have open ends, into which the parallel bars 88, 89, 91, and 92 slidably telescopically fit. In one of the preferred embodiments, the side member 81, 82 are made of square tubing.

Adjustment mounting bolts 150, 151, 154 and 155 secure the hull mount member 87 when hull mount member 87 is positioned on the gunwales. The jamb nuts 152, 153 ensure a tight secure engagement with the boat's gunwale. If the boat is of a smaller width, the hull mount members 86, 87 are moved closer to the center of the base 70. When the hull width is greater, the hull mount members 86, 87 are moved away from the center of the hull and are secured in any of the plurality of extended positions.

Figure 7:
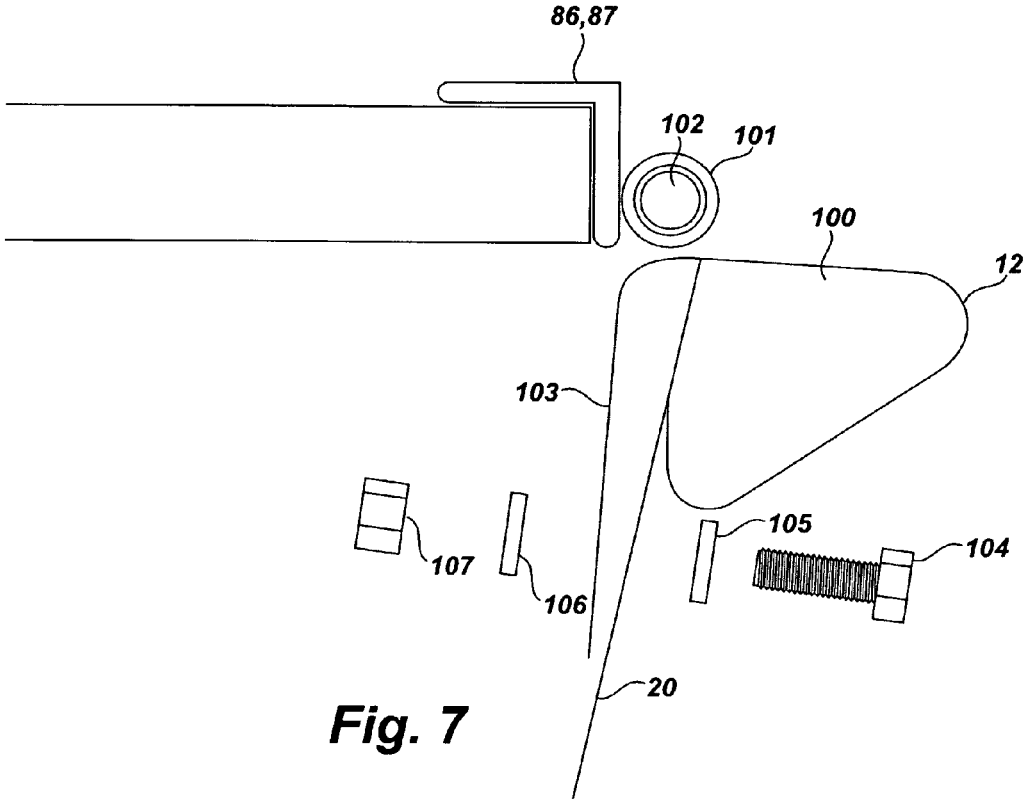
FIG. 7 is a detail side view illustrating position of the hull mount on a gunwale of a boat.

A hull mount bracket 100 is hingedly secured to each of the cross bars 90, 93, allowing the slidable hull mount members 86, 87 to adjustably engage the gunwale 12. As can be seen in detail in FIGS. 2 and 7, the hull mount bracket 100 is a right-angle piece, which is configured to "hook" over the side of the boat 10 and support the engine 24. Cylindrical hinge members 101 have exterior surfaces that are fixedly attached to the brackets 100 and to the cross bars 90, 93. A hinge rod 102 passes through the hollow hinge members 101 allowing a limited pivotal movement of the hull mount brackets 100 in relation to the hull mount member 86, 87.

When the hull mount brackets 100 are engaged with the sides 12 of the boat 10, a securing member, such as a bolt 104, is fitted through an opening in the hull 20 and the downwardly depending part 103 of the hull mount bracket 100 to securely retain the base 70 on the boat 10. A washer 105 supports the bolt 104 on the exterior surface of the hull 20, another washer 106 supports the bolt 104 on the interior surface of the hull 20, and a threaded nut 107 attaches the bolt 104 to the hull 20.

The base frame 80 is reinforced with at least one cross bar 108 that is secured between the side members 81, 82. The cross bar 108 extends transversely to longitudinal axes of the side members 81, 82 and generally in parallel to the cross members 83, 84. A tiller arm mount 110 is positioned on and extends upwardly from, the cross bar 108. A part of the steering unit 18 is supported by the tiller arm mount 110.

Figure 2:
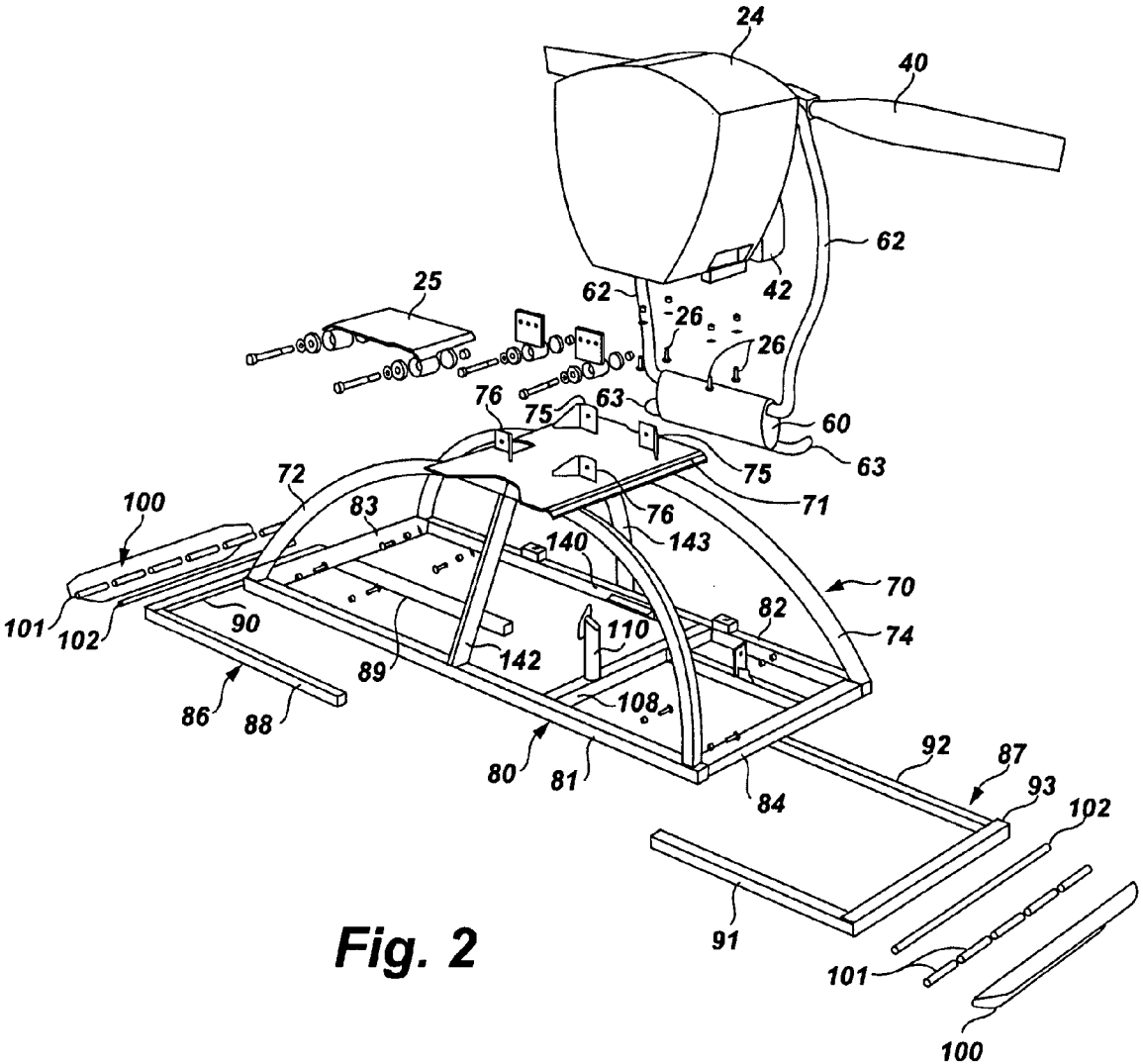
FIG. 2 is an exploded view of the mounting assembly of the present invention.
Figure 3:
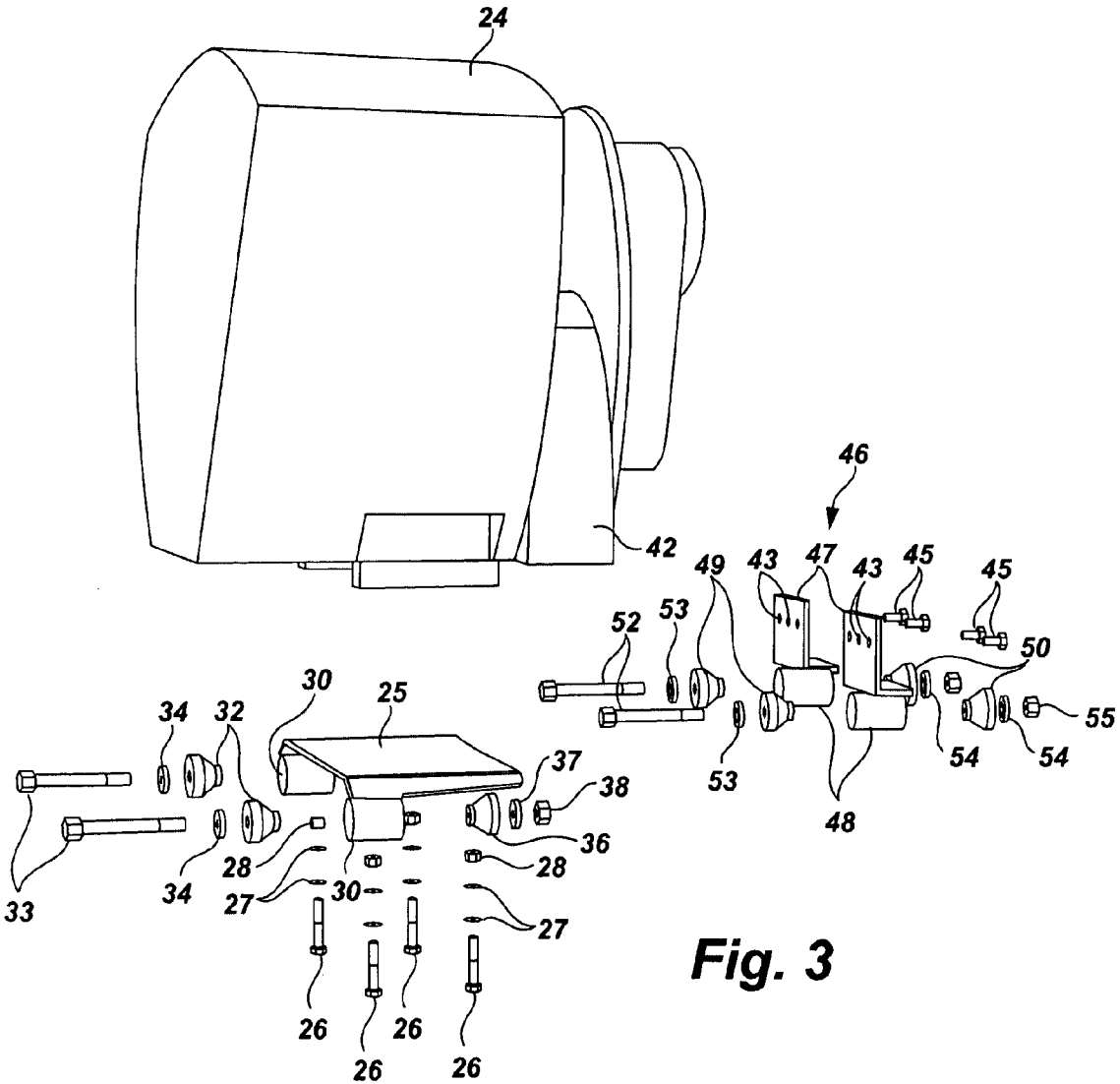
FIG. 3 is a detail exploded view of the engine mount assembly.
Figure 6:
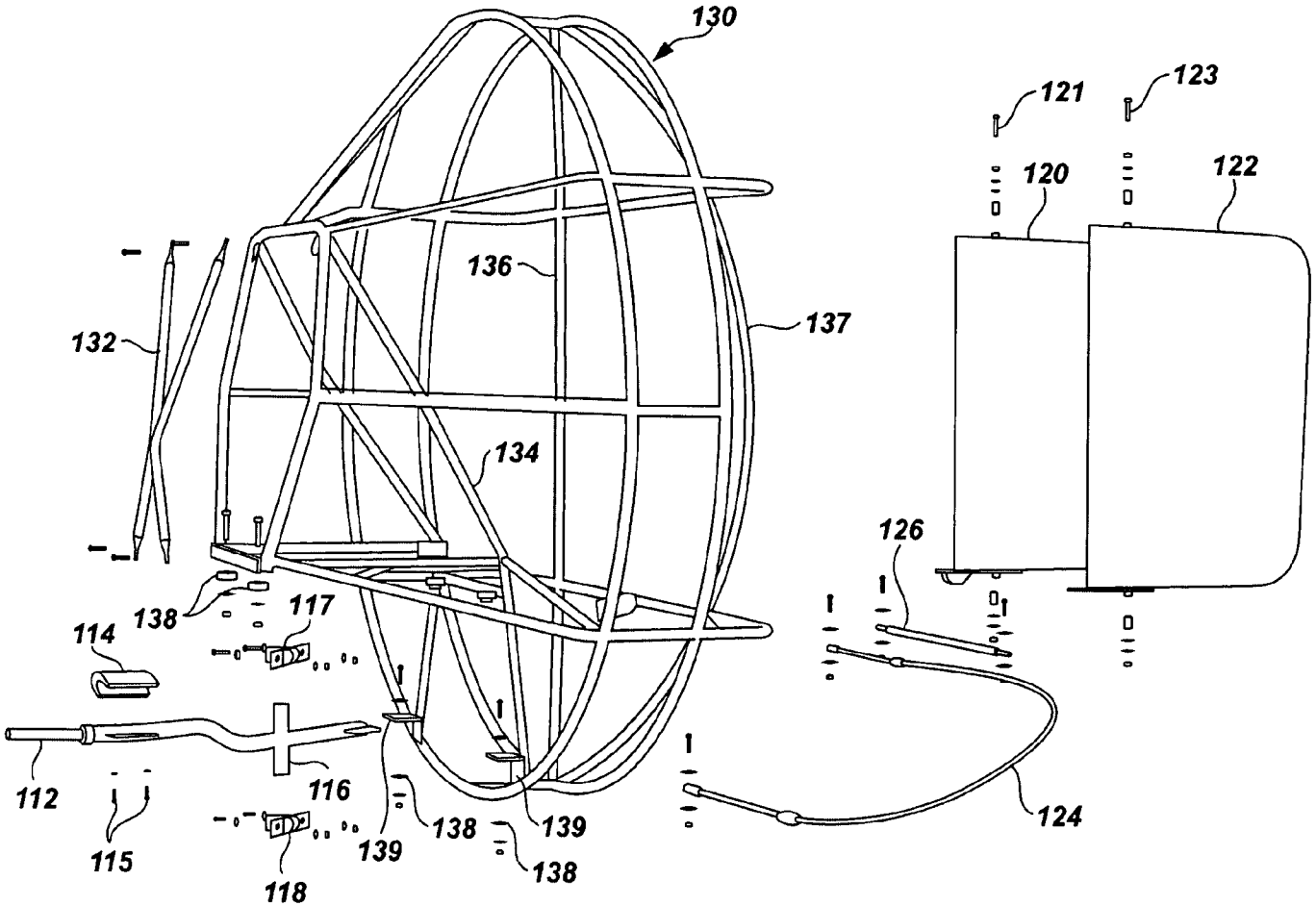
FIG. 6 is an exploded view of the cage unit.

As can be seen in more detail in FIGS. 2 and 6, the steering unit 18 comprises a tiller arm 112 and a switch box 114 mountable on the tiller arm 112 and securable by bolts 115. A tiller cross bar 116 traverses the length of the tiller bar 112. A top and bottom pillow block bearings 117, 118 are positioned between the tiller cross bar 116 and the tiller arm mount 110. A user holds the tiller arm to operate the vertically-oriented rudders 120, 122 that form a part of the steering unit. A push-pull cable 124 is operationally connected to the tiller arm 112 and the rudders 120, 122.

Figure 8:
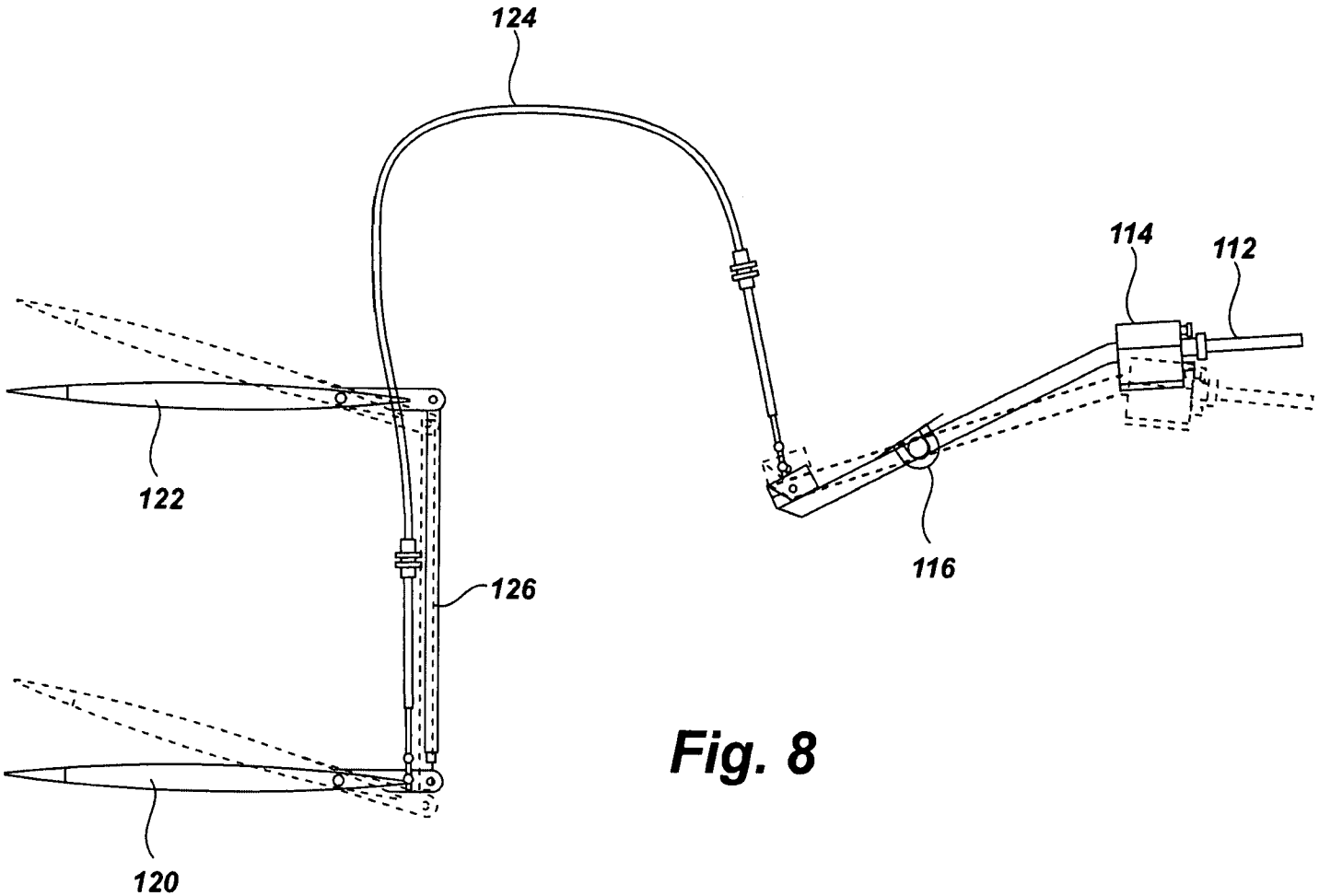
FIG. 8 is a detail view illustrating a steering assembly of the apparatus of the present invention.
Figure 9:
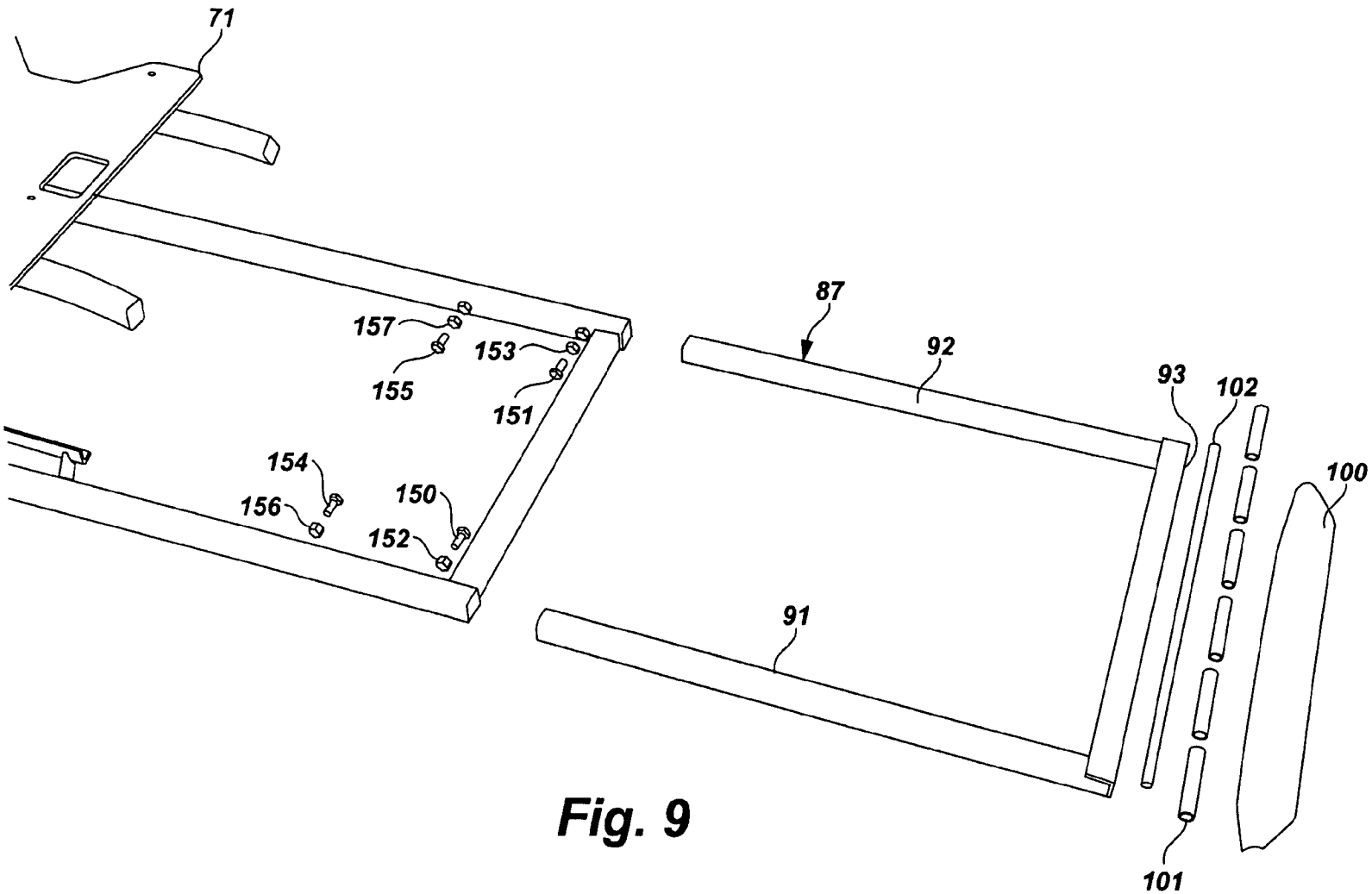
FIG. 9 is a detail view illustrating adjustable hull mounting assembly.
Figure 10:
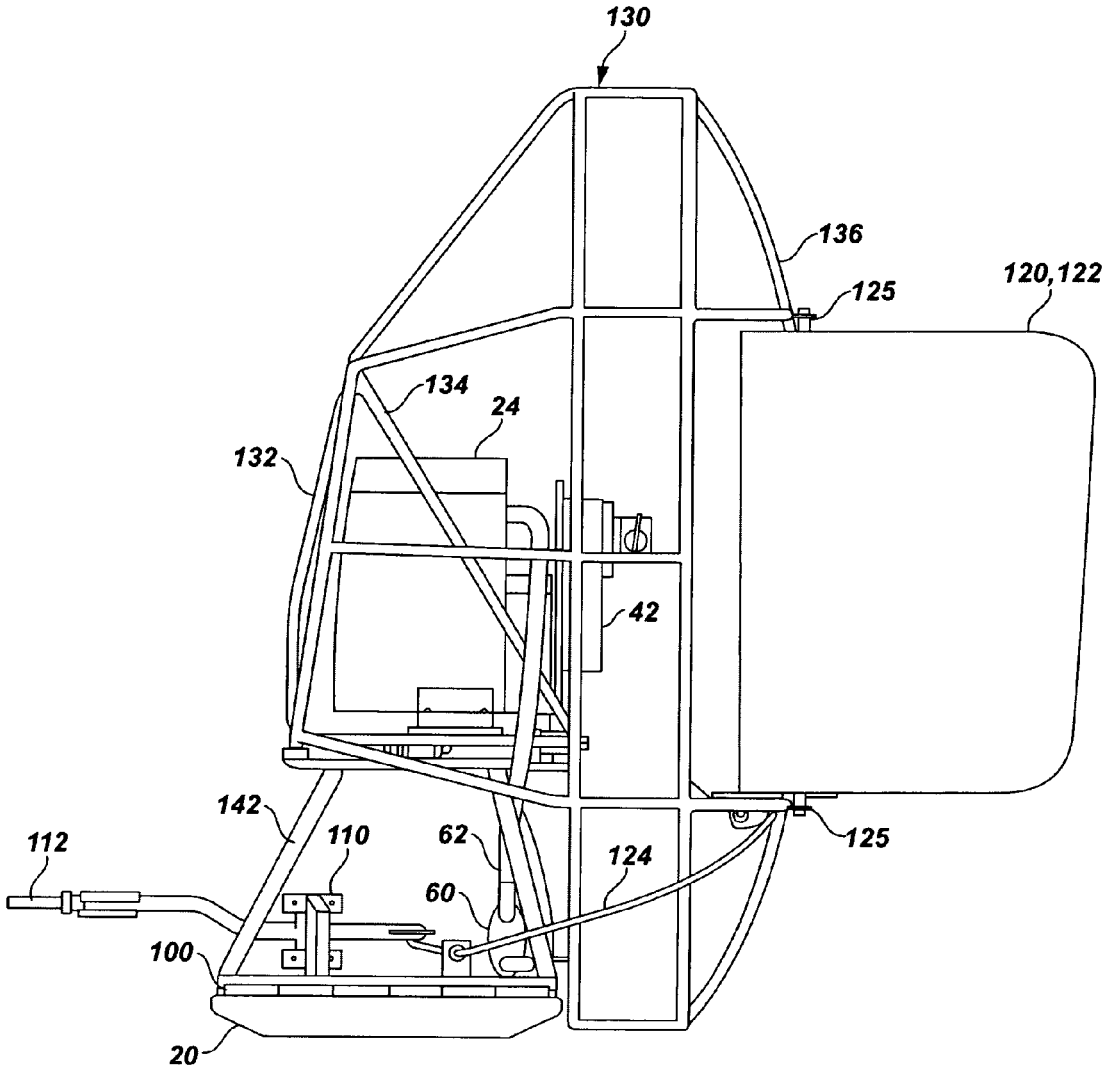
FIG. 10 is a side view of the propeller cage.
Figure 11:
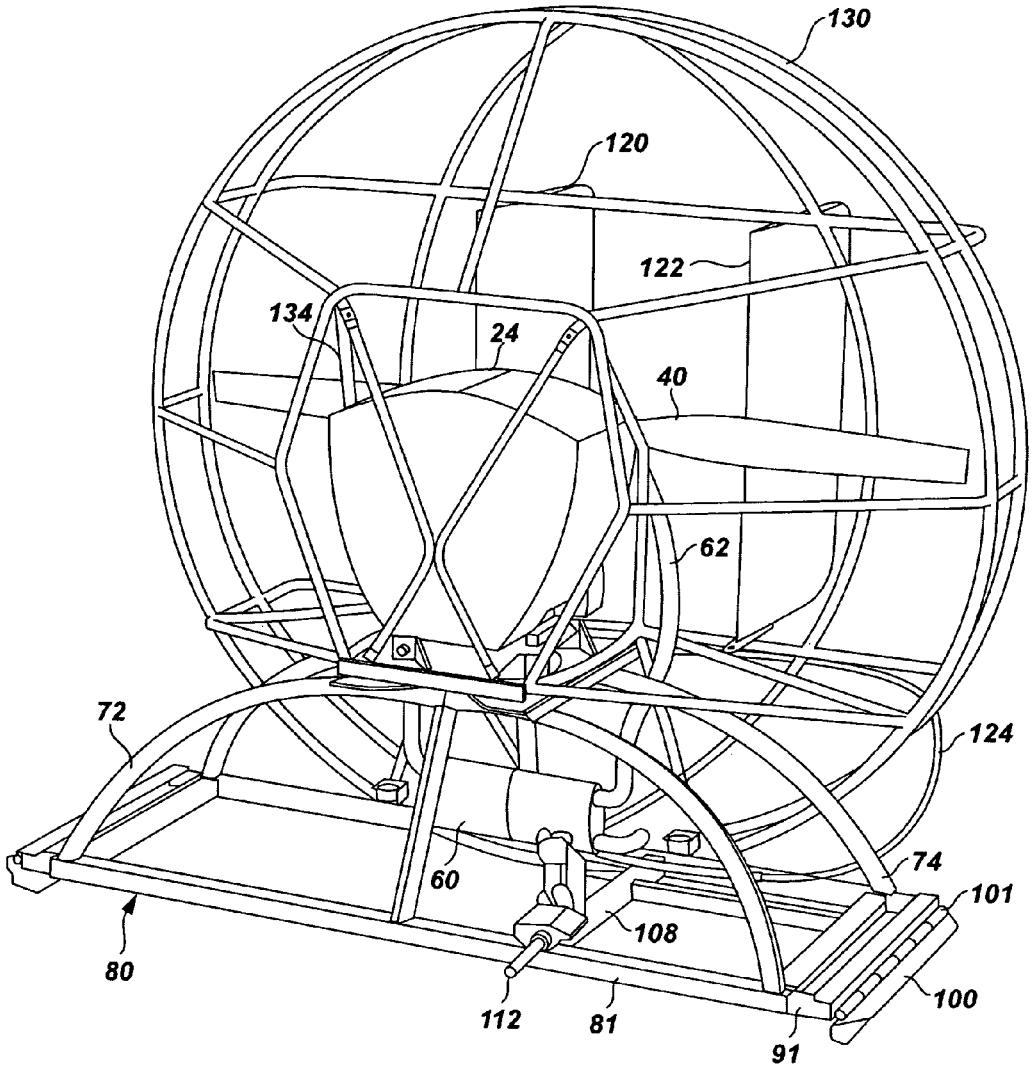
FIG. 11 is a perspective view of the propeller cage and the hull mount assembly of the present invention.
Figure 12:
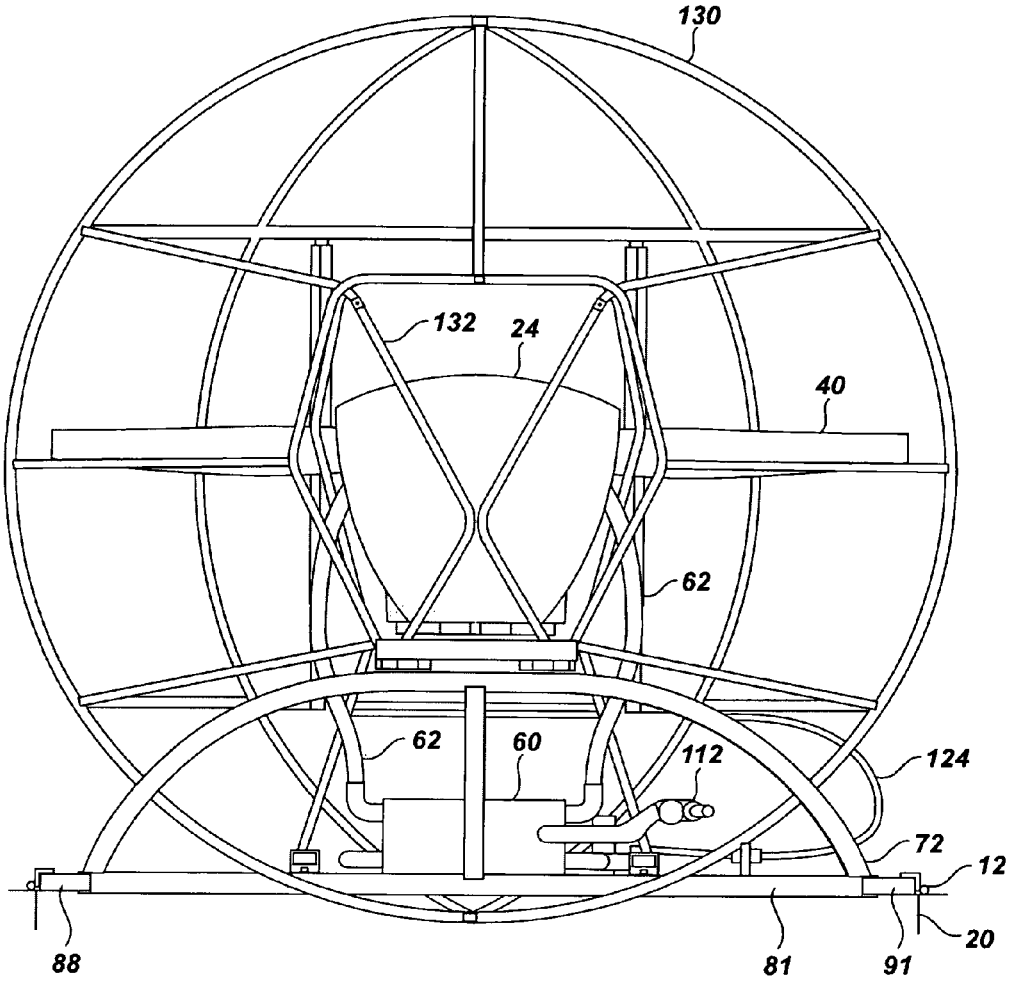
FIG. 12 is a front view of the propeller guard cage and the hull mount.
Figure 13:
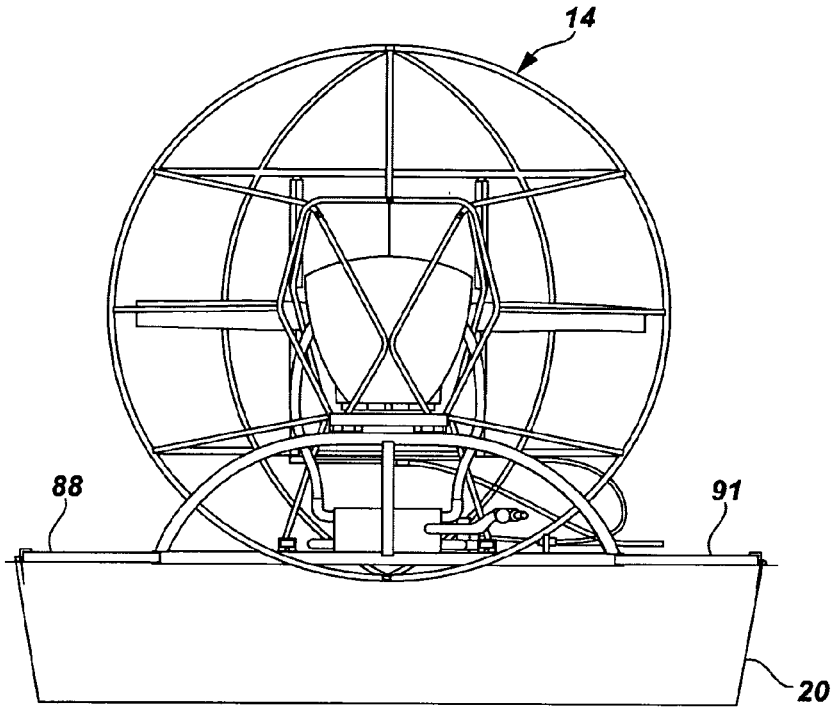
FIG. 13 illustrates the hull mount in a fully extended position to accommodate a wide width hull.
Figure 14:
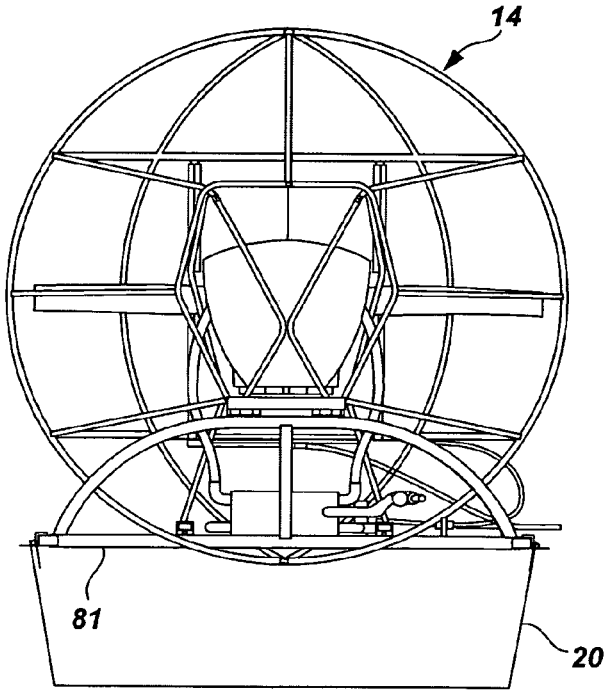
FIG. 14 illustrates the hull mount in a retracted position to accommodate a narrow width hull.

A rudder linkage rod 126 is secured between the spaced-apart rudders 120, 122 to allow the rudders to be moved in unison. The rudders 120, 122 are capable of pivotally moving more than 30 degrees in both directions from the perpendicular axis thereof. The rudder rods 121, 123 define the pivot axes for the rudders 120, 122, respectively. The pivotal movement of the rudders and of the tiller arm 112 is illustrated in phantom lines in FIG. 8. Polymer bushings 125 (FIG. 10) are interposed in the area of connection of the rudders 120, 122 with the rudder rods 121, 123. The polymer bushings allow free movement of the rudders while protecting the pipe that houses the rudder rods 121, 123.

Figure 4:
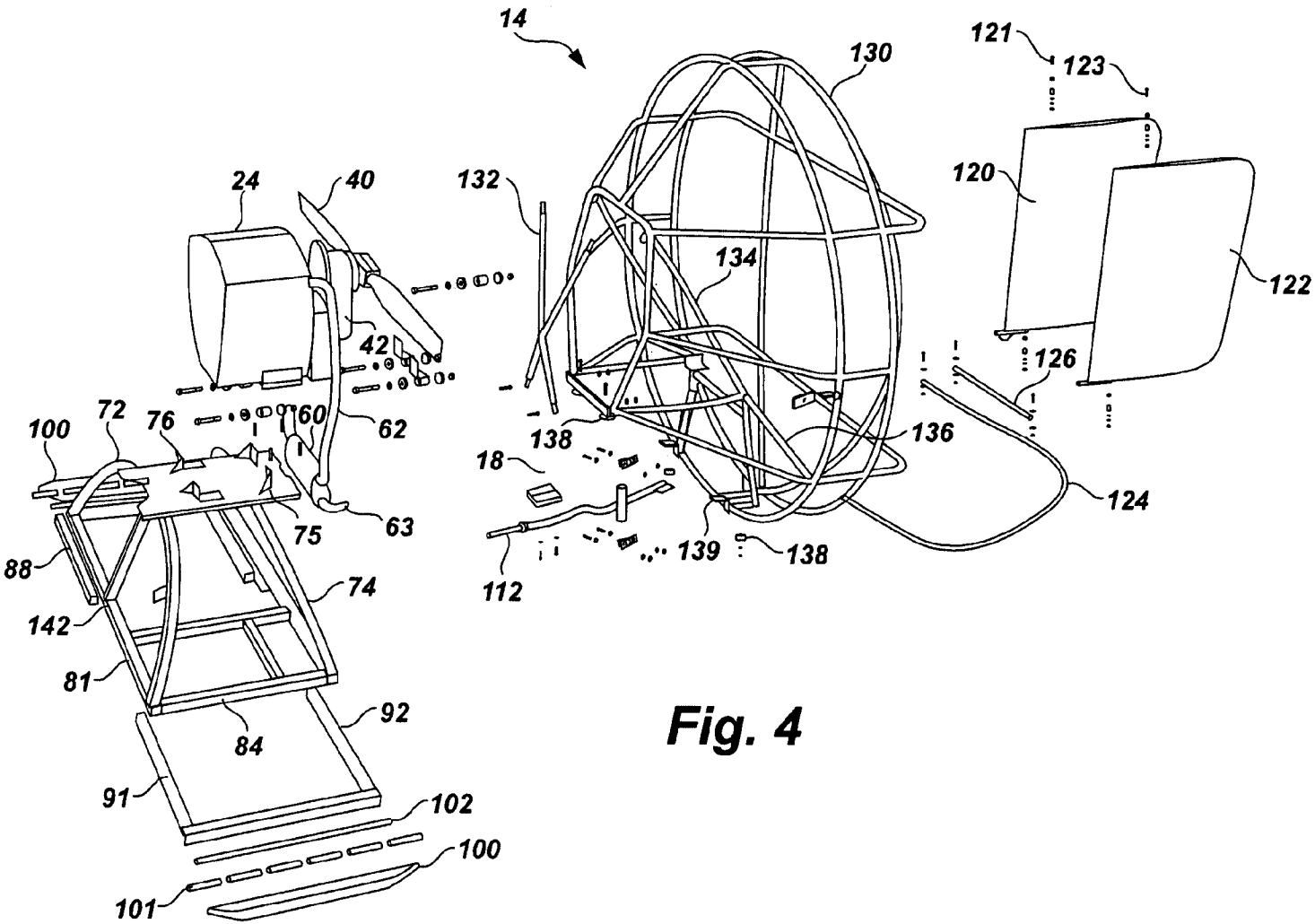
FIG. 4 is an exploded view of the cage and motor mounting assemblies.

FIGS. 4 and 6 illustrate in detail the construction of the propeller guard, or cage 130. As can be seen in the drawings, the propeller guard 130 comprises a protective cage formed from metal rods and sized to enclose the engine, the drive unit and the propeller so as to prevent such objects as tree limbs, branches, clothing, or passenger's limbs from coming in contact with the whirling propeller, which could cause devastating damage to the vessel and traumatic injury to the operator and passengers. The propeller 40 produces a rearward column of air that propels the boat 10 forward. Steering is accomplished by forced air passing across the vertical rudders 120, 122.

A propeller guard X-brace 132 is secured to the cage on the engine side. The X-brace 132 is bolted in the cage 130; it is attached to the front hoop of the propeller guard 130. The X-brace 132 stiffens the cage guard 130 and prevents weakening of the unit during operation.

A propeller guard brace 134 is oriented at an angle in relation to a vertical axis of the cage 130 and extends almost diagonally across the cage 130, from the engine side of the cage 130 to the propeller side of the cage. The diagonally-mounted propeller guard bracing prevents fore and aft movement of the propeller guard 130 during operation. The bottom ends of the propeller guard brace 134 are secured to horizontal braces 136, which extend transversely in the cage 130.

The cage 130 also comprises rudder bar braces 136, 137 and rubber propeller guard mounts 138 that secure the propeller guard to the supporting brackets 139 fitted in the cage 130. The arched rudder braces 136 prevent the propeller guard 130 from flexing during operation of the boat 10.

A muffler mount 140 is provided in the base 70 for supporting the muffler 60. A reinforcing upright support member 142 radially extends from the side member 81 to support the arched leg 72. A similar support member 143 extends from the side member 82 to radially support the arched leg 74.

The propulsion unit 14 can be manufactured and sold separately from the boat 10, allowing the buyer to position the propulsion unit 14 on any available boat, thereby retrofitting a conventional boat to become an air-thrust vehicle. Similarly, the propulsion unit 14 can be positioned on an ice- or snow-traversing vehicle to provide a power pack for the vehicle.

Figure 5:
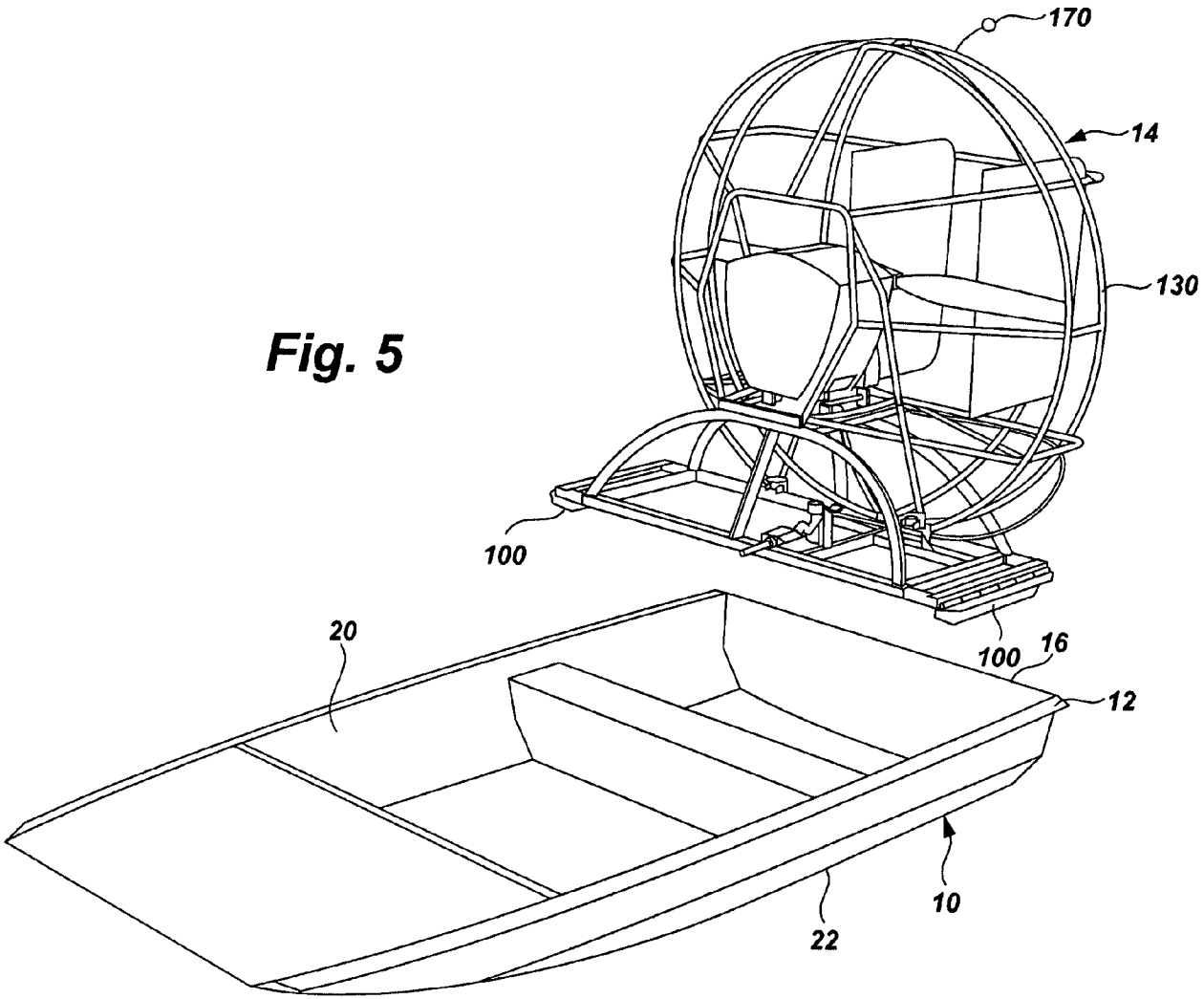
FIG. 5 is a perspective view illustrating the air-thrusting motor in a position to be mounted on a stern of a boat.

To mount the propulsion unit 14, the operator will suspend the propulsion unit above the boat hull 20 using a suspension device, such as a winch or a small crane, schematically designated by numeral 170 in FIG. 5. The operator suspends the propulsion unit 14 positioning the rear hoop 136 of the propeller guard just in front of the boat transom. The operator then loosens jam nuts and bolts (151-157) on the base side members. The operator then extends the mounting slides 86, 87 until contact is made with the boat hull sides. Then, the mounting hull brackets 100 are clamped to the side of the boat hull, ensuring that satisfactory contact is made with the gunwale and inside of hull sides.

The operator then drills two or more holes through each hull side using holes in the downwardly depending part 103 of the brackets 100. The propulsion unit 14 is secured using provided 7/16" stainless steel bolts 104, washers 105, 106 and locking nuts 107. The propulsion unit is then centered on the hull 20 while the operator tightens the jam bolts and jam nuts.

The suspension device can now be disconnected from the propulsion unit 14. After checking the tightness of all bolts and nuts, the operator can connect a battery and fuel line.

To operate the air-thrust vehicle, the operator gently twists a throttle grip on the tiller arm 112 to accelerate. The operator can push tiller to starboard to direct thrust to port, turning boat to port or push tiller to port to direct thrust to starboard, turning boat to starboard. To decelerate, the operator gently untwists the throttle grip on the tiller arm.

The hull mount members 86, 87 hinge and move laterally, allowing the mounting assembly to be fitted on gunwales of different size and types of boat hulls. The caged engine and the base frame of the apparatus of the instant invention can be easily removed from a boat and stored in a protected area when not in use. When required, the engine with the base frame can be secured on a flat-bottom boat, changing a conventional boat to an air boat. Such modification is less expensive than buying a full size airboat. The modified boat is easy to operate, compared with a boat using an outboard motor, and is safer than a full size airboat because it uses less power.

The air-thrusting engine provides for considerably less fuel consumption; less noise, and diminished impact on wildlife. Also, a full size airboat can be more powerful than is required for many shallow water navigation tasks. The instant design allows smaller boats to be retrofitted with the air-thrusting engine for use in shallow waters.

One of the drawbacks of conventional airboats is the fact that it has a fairly intricate steering system, as well as a power source requiring a fuel regulator, a speed regulator, properly positioned vanes on the propeller, etc. These limitations are eliminated in the instant design, which uses a package unit.

Another advantage of the instant invention over a so-called "mini airboat" is that it allows the boat retrofitted with the instant invention to have a lower center of gravity, which minimizes the chance of the boat sinking or capsizing. The engine in the instant design is positioned in the lower part of the base, while the propeller does not extend too far into the hull.

Still another benefit of the instant design is that the steering has been aligned and adjusted and contained within the system, as well as the fuel regulator or the throttle. In this way, an operator can remove this motor unit and place it on another boat without worrying about modifications or adjustment. The unit is already self-contained. The motor unit can be placed on a flat bottom boat of a limited width. It is envisioned that the width that the unit of this invention can work well with a gunwale of approximately 62 to about 90 inches. It is also envisioned that the air-thrusting unit of the present invention may be installed on a vehicle configured to move on ice, snow or dry land.

Many changes and modifications can be made in the design of the present invention without departing from the spirit thereof. I, therefore, pray that my rights to the present invention be limited only by the scope of the appended claims.

I claim:

1. An air-thrusted vehicle, comprising:

a hull having upwardly extending hull sides;

an air-thrusting propulsion unit configured for detachable mounting on the hull sides, said propulsion unit comprising an engine, a propeller operationally connected to the engine, a drive unit mounted between the engine and the propeller, a muffler operationally connected to the engine and a base assembly configured to move between a retracted position and plurality of expanded width positions for accommodating various width hulls, said base assembly comprising a base frame having elongated tubular side members secured in a substantially parallel relationship to each other and hull mount members telescopically engageable with said side members, said hull mount members being configured to rest on and hingedly engage the hull sides, said hull mount members comprising a generally U-shaped body having a pair of parallel slide members, a cross bar secured between the slide members and a hull mount bracket hingedly secured to the cross bar, said base assembly further comprising an arched leg secured to and extending upwardly from, each of said side members, a base plate positioned on arched legs, and an engine mount plate for supporting the engine on the base plate, said engine mount plate being provided with a means for absorbing vibration of the engine wherein said means for absorbing vibration of the engine comprises a plurality of flexible resilient members mounted in cylindrical receivers, said cylindrical receivers being fixedly attached to the engine mount plate.

2. An air-thrusted vehicle, comprising:

a hull having upwardly extending hull sides;

an air-thrusting propulsion unit configured for detachable mounting on the hull sides, said propulsion unit comprising an engine, a propeller operationally connected to the engine, a drive unit mounted between the engine and the propeller, a muffler operationally connected to the engine and a base assembly configured to move between a retracted position and plurality of expanded width positions for accommodating various width hulls, said base assembly comprising a base frame having elongated tubular side members secured in a substantially parallel relationship to each other and hull mount members telescopically engageable with said side members, said hull mount members being configured to rest on and hingedly engage the hull sides, said hull mount members comprising a generally U-shaped body having a pair of parallel slide members, a cross bar secured between the slide members and a hull mount bracket hingedly secured to the cross bar, said base assembly further comprising an arched leg secured to and extending upwardly from, each of said side members, a base plate positioned on arched legs, and a means for mounting the drive unit on said base plate, wherein said means for mounting the drive unit on said base plate comprises a pair of attachment brackets configured for securing to the drive unit and a corresponding pair of rear brackets extending upwardly from the base plate, said attachment brackets being configured to detachably secure the drive unit to the base plate.

3. The apparatus of claim 2, further comprising a means for reducing vibration generated by the drive unit.

4. The apparatus of claim 3, wherein said means for reducing vibration generated by the drive unit comprises a plurality of flexible resilient vibration-absorbing members mounted in hollow sleeves secured to said attachment brackets.

5. The apparatus of claim 2, wherein each of said attachment brackets has a generally L-shaped configuration.

6. An air-thrusted vehicle, comprising:

a hull having upwardly extending hull sides;

an air-thrusting propulsion unit configured for detachable mounting on the hull sides, said propulsion unit comprising a base assembly configured to move between a retracted position and plurality of expanded width positions for accommodating various width hulls, wherein said base assembly comprises a substantially rectangular base frame having elongated tubular side members and perpendicularly secured cross members for retaining the side members in a generally parallel relationship to each other, said base frame further comprising a pair of oppositely positioned hull mount members configured to slidably telescopically engage with side members, said hull mount members configured to hingedly engage the hull sides.

7. The apparatus of claim 6, wherein said vehicle is a flat-bottomed boat, and wherein said base assembly is configured for detachable mounting on gunwales of the hull sides.

8. An air-thrusted marine vehicle, comprising:

a hull having upwardly extending hull sides with gunwales;

an air-thrusting propulsion unit configured for detachable mounting on the gunwales, said propulsion unit comprising an engine, a propeller operationally connected to the engine, a drive unit mounted between the engine and the propeller, a muffler operationally connected to the engine, and a base assembly configured to move between a retracted position and plurality of expanded width positions for accommodating various width hulls, while being configured to hingedly engage the gunwales, said base assembly comprising an arched leg secured to and extending upwardly from, each of said tubular side members, a base plate positioned on the arched legs and an engine mount plate for supporting the engine on the base plate, wherein said engine mount plate is provided with a means for absorbing vibration of the engine comprising a plurality of flexible resilient members mounted in cylindrical receivers, said cylindrical receivers being fixedly attached to the engine mount plate.

9. An air-thrusted marine vehicle, comprising:

a hull having upwardly extending hull sides with gunwales;

an air-thrusting propulsion unit configured for detachable mounting on the gunwales, said propulsion unit comprising propulsion unit comprises an engine, a propeller operationally connected to the engine, a drive unit mounted between the engine and the propeller, and a muffler operationally connected to the engine, and a base assembly configured to move between a retracted position and plurality of expanded width positions for accommodating various width hulls, while being configured to hingedly engage the gunwales, said base assembly comprising an arched leg secured to and extending upwardly from, each of said tubular side members, a base plate positioned on the arched legs, an engine mount plate for supporting the engine on the base plate, and a means for mounting the drive unit on said base plate comprising a pair of L-shaped attachment brackets configured for securing to the drive unit and a corresponding pair of rear brackets extending upwardly from the base plate, said attachment brackets being configured to detachably secure the drive unit to the base plate.

10. The apparatus of claim 9, further comprising a means for reducing vibration generated by the drive unit comprising a plurality of flexible resilient vibration-absorbing members mounted in hollow sleeves secured to said L-shaped attachment brackets.

11. A propulsion unit for an air-thrust vehicle having upwardly extending spaced-apart vehicle sides, the propulsion unit comprising an engine, a propeller operationally connected to the engine, a drive unit mounted between the engine and the propeller, a muffler operationally connected to the engine, and a base assembly configured to detachable mounting on the vehicle sides, said base assembly being configured to move between a retracted position and plurality of expanded width positions for accommodating various width vehicles, while being configured to hingedly engage the vehicle sides, said base assembly comprising an arched leg secured to and extending upwardly from, each of said tubular side members, a base plate positioned on the arched legs, and an engine mount plate for supporting the engine on the base plate, wherein said engine mount plate is provided with a means for absorbing vibration of the engine comprising a plurality of flexible resilient members mounted in cylindrical receivers, said cylindrical receivers being fixedly attached to the engine mount plate.

12. A propulsion unit for an air-thrust vehicle having upwardly extending spaced-apart vehicle sides, the propulsion unit comprising an engine, a propeller operationally connected to the engine, a drive unit mounted between the engine and the propeller, a muffler operationally connected to the engine, and a base assembly configured for detachable mounting on the vehicle sides, said base assembly being configured to move between a retracted position and plurality of expanded width positions for accommodating various width vehicles, while being configured to hingedly engage the vehicle sides, said base assembly comprising an arched leg secured to and extending upwardly from, each of said tubular side members, and a base plate positioned on the arched legs, and further comprising a means for mounting the drive unit on said base plate comprising a pair of L-shaped attachment brackets configured for securing to the drive unit and a corresponding pair of rear brackets extending upwardly from the base plate, said attachment brackets being configured to detachably secure the drive unit to the base plate.

13. The apparatus of claim 12, further comprising a means for reducing vibration generated by the drive unit comprising a plurality of flexible resilient vibration-absorbing members mounted in hollow sleeves secured to the L-shaped attachment brackets.

* * * * *